United States Patent [19]

Ramisa Navarro

[11] Patent Number: 4,509,683

[45] Date of Patent: Apr. 9, 1985

[54] APPARATUS FOR DISPERSING ATOMIZED LIQUID

[76] Inventor: Josep Ramisa Navarro, Rbla. Sant Just, 13, Sant Just Desvern, Barcelona, Spain

[21] Appl. No.: 445,065

[22] Filed: Nov. 29, 1982

[30] Foreign Application Priority Data

Nov. 30, 1981 [ES] Spain ..... 507.555
Sep. 30, 1982 [ES] Spain ..... 516.091

[51] Int. Cl.[3] ..... B05B 9/06

[52] U.S. Cl. ..... 239/77; 415/213 B; 416/186 R

[58] Field of Search ..... 239/77, 78, 14; 416/186 R; 415/213 B

[56] References Cited

U.S. PATENT DOCUMENTS

| | | | |
|---|---|---|---|
| 1,809,424 | 6/1931 | Pereboom | 416/186 R |
| 2,561,432 | 7/1951 | Tranter | 239/77 |
| 2,635,920 | 4/1953 | Boyce | 239/77 |
| 2,886,249 | 5/1959 | Sidlow | 239/77 |
| 3,504,853 | 4/1970 | De Lorme | 239/77 |
| 3,584,968 | 6/1971 | Keith | 416/186 R |

FOREIGN PATENT DOCUMENTS

| | | | |
|---|---|---|---|
| 100901 | 9/1925 | Austria | 415/213 B |
| 1572611 | 7/1980 | United Kingdom | 416/86 R |

*Primary Examiner*—Andres Kashnikow
*Assistant Examiner*—Michael J. Forman
*Attorney, Agent, or Firm*—Steinberg & Raskin

[57] ABSTRACT

Atomized liquid dispersing apparatus includes a substantially cylindrical casing having an open rearward end constituting an air inlet and a motor driven centrifugal rotor for drawing air into the air inlet, the rotor being integral with an annular concentric deflector having a larger diameter than the outer blade diameter and a width substantially equal to the width of the blades, the deflector also including an inwardly directed concentric collar. The deflector defines an open concentric space outwardly of the outer periphery of the rotor blades in which the direction of airflow is redirected from a substantially radial flow to a substantially axial flow as the rotor and deflector rotate together, the airflow then being directed into a subsequent annular passage. The casing has a nozzle provided at its forward end in communication with the annular passage in which a ring-shaped duct is provided which is adapted to receive water under pressure which is then discharged through a series of atomizers into the airflow issuing from the neck of the nozzle.

6 Claims, 5 Drawing Figures

APPARATUS FOR DISPERSING ATOMIZED LIQUID

BACKGROUND OF THE INVENTION

The present invention relates to apparatus for dispersing atomized liquid, e.g., water, adapted for discharging fluids under large pressure and with a great range or throw.

The present invention is particularly directed to an atomized water dispersing apparatus which incorporates a new and improved air impeller having improved aerodynamic characteristics and which will impart greater velocity, pressure and range to the liquid being dispersed than can be obtained with conventional impellers of the prior art.

SUMMARY OF THE INVENTION

Generally, the atomized liquid dispersing apparatus of the present invention comprises a substantially cylindrical casing having a open rearward end constituting an air inlet, the air being drawn into the casing by a centrifugal rotor driven by a motor. An integral annular deflector surrounds the rotor and transforms the tangential or radial airflow into an axial flow and which directs the airflow into and through an annular passage defined between the casing and the housing of the rotor driving motor. The annular passage opens into a nozzle provided at the forward end of the casing in which nozzle a ring-shaped duct is situated proximate to its periphery, the duct adapted to receive water under pressure and from which the water is discharged through a series of atomizers.

The following considerations are notable in connection with the provision and structural arrangement of the air impeller constituting the essential component of the atomized liquid dispersing apparatus of the present invention.

(A) Centrifugal rotors are known to provide a significantly higher pressure than can be obtained using axial rotors of the same diameter so that all of the advantages inherent in centrifugal rotors are obtained by the apparatus of the present invention. However, an airflow is obtained by the apparatus of the present invention which in the past has only been obtained using axial rotors. Accordingly, the present invention provides a high pressure airflow having a large velocity and throw in an axial direction with less noise and with a significantly less complicated construction than has been possible heretofore.

(B) In order to obtain such an axial airflow, the cylindrical deflector is formed integrally with the rotor cap by providing an annular prolongation of the rotor cap to the diameter of the deflector to which it is integrally connected. The width of the deflector is substantially equal to the width of the upper edges of the rotor blades so that an open concentric space is defined outwardly of the outer periphery of the rotor blades having suitable dimensions through which the air is driven in an axial direction.

(C) The entry of the air through the rearward end of the casing constituting the air inlet means may be conducted through a fixed deflector toward the center of the rotating deflector integral with the rotor thereby eliminating the usual spiral casing of centrifugal rotors.

Additionally, the atomized liquid dispersing apparatus is preferably rotatably mounted on a substantially horizontal transverse shaft in order to provide a capability for varying the angle at which atomized water can be projected. Moreover, the casing is preferably also rotatably mounted on a substantially vertical shaft in order to allow a variation in the lateral direction in which the atomized liquid is discharged.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
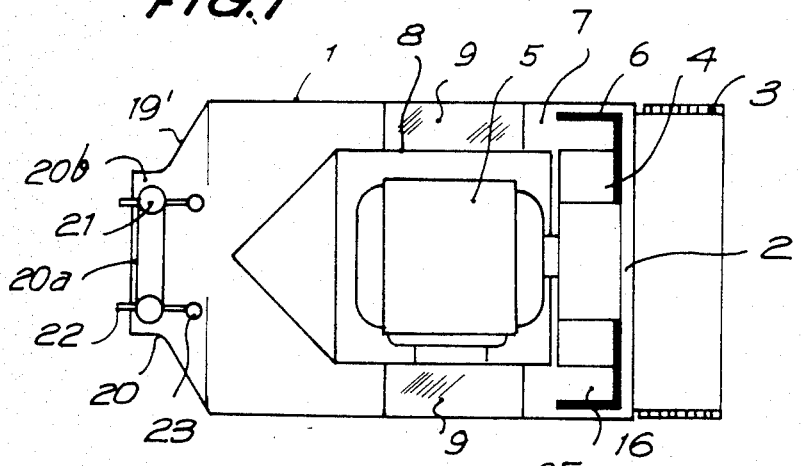
FIG. 1 is a schematic side elevation view in section of an apparatus in accordance with the present invention.

Referring now to the drawings wherein like reference characters designate identical or corresponding parts throughout the several views, atomized water dispersing apparatus in accordance with the present invention includes a cylindrical casing 1 having an open rearward end 2 constituting an air inlet means in which an air filter 3 is provided. A centrifugal rotor 4 driven by a motor 5 acts to draw air into the air inlet means. The rotor 4 is formed integrally with a surrounding annular deflector 6 which redirects the substantially radial direction of the airflow at the periphery of the rotor to a substantially axial airflow and for further directing the airflow into an annular passage 7 formed between the casing 1 and a housing 8 in which the motor 5 is situated. The annular passage 7 has a cross section which substantially corresponds to that of the open concentric space defined outwardly of the outer periphery of the rotor blades by the deflector 6. A plurality of fins 9 radially projecting from the motor housing 8 and which are connected to the inner surface of outer casing 1 extend through the annular passage 7.

Figure 4:
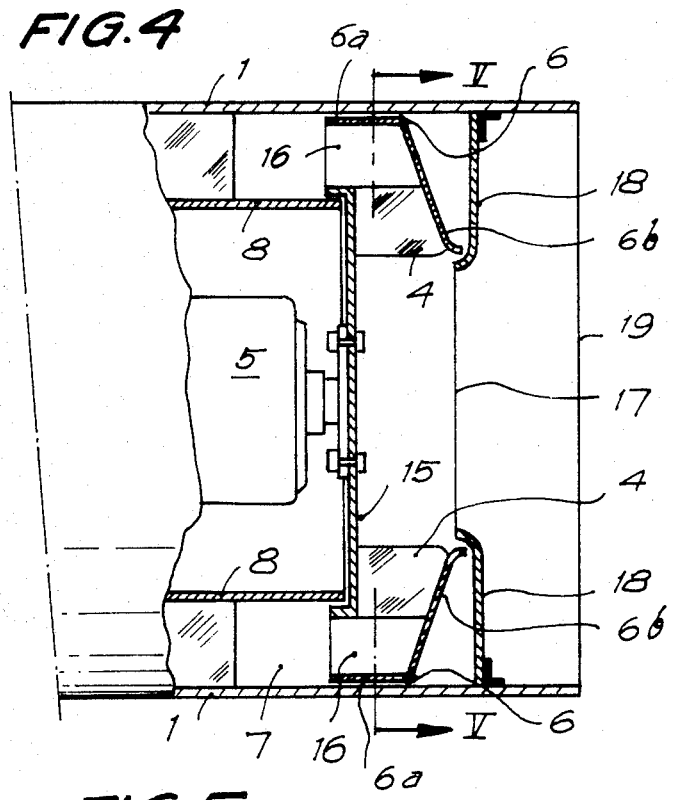
FIG. 4 is a side elevation view in partial section of an air impeller rotor forming a component of the present invention.
Figure 5:
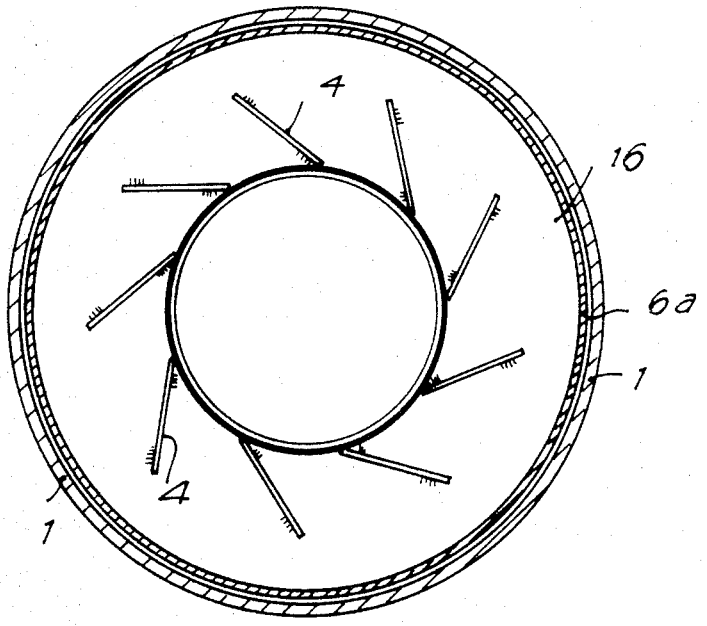
FIG. 5 is a section view taken along line V—V of FIG. 4.

A description of the air impeller rotor which constitutes the essential component of the apparatus of the present invention will now be described with reference to FIGS. 4 and 5.

The rotor comprises a transverse disk 15 attached to the shaft of the motor 5, the disk 15 closing the housing to airflow inwardly of the rotor blades 4. The blades 4 are mounted on an outer peripheral region of disk 15. A deflector 16 is integrally formed with the rotor and includes a cylindrical portion **6*a* having an axial length which is substantially equal to the axial width of the rotor blades 4 and which has a diameter greater than the outer diameter of the blades. The deflector 6 further includes a concentric inwardly directed collar 6*b* forming a prolongation of the cylindrical portion 6*a*. The deflector 6 thereby defines an open concentric space 16** outwardly of the outer perimeter of the rotor blades in which the substantially radial direction of airflow is redirected to a substantially axial airflow.

A central air inlet mouth 17 of the rotor is defined by a fixed deflector 18 which directs the air from the entrance 19 of the housing to the central mouth 17 of the rotor.

From the foregoing description of the air impeller rotor, it is seen that the significant advantage is obtained that a relatively high pressure axial flow of air is obtained, such high pressure axial flow being required in many applications and which has not been possible to be obtained heretofore with conventional centrifugal rotors, the latter being most desirable where high pressures and velocities are required.

Figure 2:
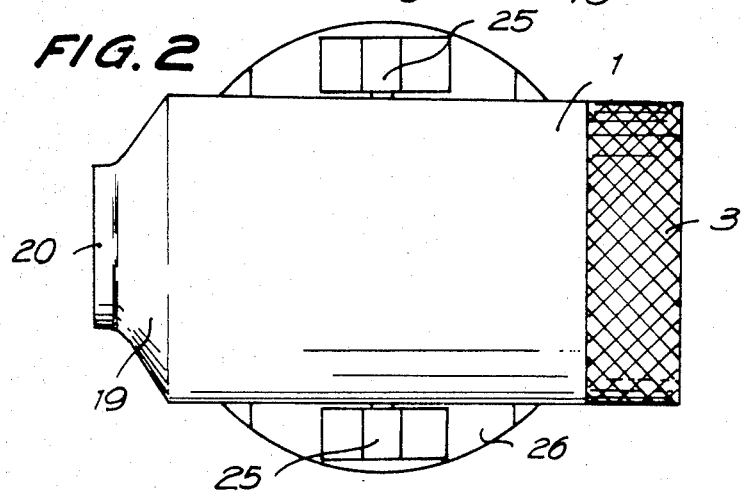
FIG. 2 is a top plan view of the apparatus illustrated in FIG. 1.

Referring back to FIGS. 1 and 2, the forward end of casing 1 has a nozzle 19 formed with a neck 20 provided therein. A ring-shaped duct 21 is situated within the nozzle 19. The duct 21 defines with the neck 20 a central outlet 20*a* and an outer annular outlet 20*b* for the air impelled by the centrifugal rotor through the annular passage 7. The ring-shaped duct 21 is itself provided with a series of atomizers 22 to which pressurized water is fed through an inlet 23.

In operation, the air impelled axially by the centrifugal rotor 4 is discharged at high axial pressure and with a high velocity through the radial open concentric space 16 defined outwardly of the outer periphery of the rotor blades into the annular passage 7 arriving at the outlets 20*a* and 20*b* of nozzle 20 in a proportionally distributed manner so that the central zone of air issues in a conical form while air being discharged through the annular zone 20*b* obtains an annular form, the air intersecting with the interposition of the water under pressure atomized by the atomizers 22 so that the water is entrained by the airjets and dispersed to a great distance.

Figure 3:
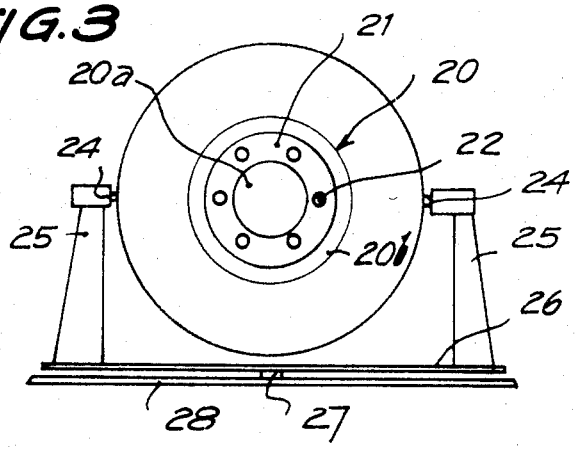
FIG. 3 is a front elevation view of the apparatus illustrated in FIG. 1.

Referring to FIG. 3, the casing 1 is mounted so as to oscillate on a transversely extending substantially horizontal shaft by means of pivots 24 supported by support arms 25 fixed on a plate 26. Moreover, the plate 26 is mounted on a substantially vertical central shaft 27 over a base 28 which supports the assembly.

Generally, the materials employed in the construction of the apparatus of the present invention as well as the design and dimensions of the assembly and its components, are conventional and do not form a part of the present invention.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for dispersing atomized liquid, comprising:

a casing having an open rearward end constituting air inlet means;

a centrifugal rotor mounted in said casing for rotation about an axis of rotation, said rotor including rotor blades defining an outer blade diameter, each blade having a width in the axial direction;

motor means situated in said casing for rotating said rotor;

an annular deflector integrally connected to said centrifugal rotor to rotate therewith, said deflector being concentric with said rotor and having a diameter greater than said outer blade diameter and a width substantially equal to the width of said blades, to define an open annular concentric space situated radially outwardly of the outer periphery of said rotor blades;

means defining an annular passage within said casing downstream of and communicating with said open concentric space, said annular passage being substantially coextensive with said annular concentric space;

nozzle means provided at a forward end of said casing and communicating with said annular passage; and means for injecting liquid into the region defined by said nozzle means;

whereby rotation of said rotor jointly with said integral deflector, causes air to be drawn into said casing through said air inlet means and directed substantially radially into said open concentric space, where the flow of air is redirected by said integral deflector to a substantially axial direction, whereupon the airflow is conducted through said annular passage.

2. The combination of claim 1 wherein said rotor comprises a transverse disk to an outer periphery of which said rotor blades are connected, said disk closing said housing to airflow inwardly of said rotor blades.

3. The combination of claim 1 wherein said motor means are mounted in a motor housing and said motor housing and said casing define said annular passage between them.

4. The combination of claim 1 wherein said annular deflector comprises a concentric cylindrical deflector position situated outwardly of and spaced from the outer edges of said rotor blades and a concentric inwardly directed collar portion extending rearwardly from said cylindrical portion which together with said cylindrical portion acts to redirect the substantially radial airflow to substantially axial airflow.

5. The combination of claim 1 wherein said nozzle means terminate at a forward neck region; and further comprising a ring-shaped duct extending proximate to an inner periphery of said neck region, said duct defining therein a central air outlet and an outer annular air outlet, said duct adapted to receive liquid under pressure and being provided with a plurality of atomizer means for discharging liquid from said duct and dispersing the same into jets of air discharging through said neck region of said nozzle means.

6. The combination of claim 1 wherein said casing is mounted for oscillation on a substantially horizontal shaft for varying the angle at which the air and liquid dispersed therein is discharged from said nozzle means, and wherein said casing is further mounted on a substantially vertical shaft for varying the lateral direction at which the air and liquid dispersed wherein is discharged from said nozzle means.

* * * * *